US006514060B1

(12) United States Patent
Ishiguro et al.

(10) Patent No.: US 6,514,060 B1
(45) Date of Patent: Feb. 4, 2003

(54) SCROLL TYPE COMPRESSOR HAVING A PRESSURE CHAMBER OPPOSITE A DISCHARGE PORT

(75) Inventors: Suguru Ishiguro, Sakai (JP); Yoshitaka Shibamoto, Sakai (JP); Mikio Kajiwara, Sakai (JP); Nobuhiro Nojima, Sakai (JP); Ryohei Deguchi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/890,883

(22) PCT Filed: Oct. 4, 2000

(86) PCT No.: PCT/JP00/06928

§ 371 (c)(1),
(2), (4) Date: Aug. 6, 2001

(87) PCT Pub. No.: WO01/42659

PCT Pub. Date: Jun. 14, 2001

(30) Foreign Application Priority Data

Dec. 6, 1999 (JP) ..... 11-346307

(51) Int. Cl.[7] ..... F04C 18/04
(52) U.S. Cl. ..... 418/55.5; 418/57; 418/188
(58) Field of Search ..... 418/55.5, 57, 188

(56) References Cited

U.S. PATENT DOCUMENTS 3,884,599 A * 5/1975 Young et al. ..... 418/55.5
4,645,437 A * 2/1987 Sakashita et al. ..... 418/55.5
4,696,630 A * 9/1987 Sakata et al. ..... 418/55.5
5,090,878 A * 2/1992 Haller ..... 418/55.5
5,129,798 A * 7/1992 Crum et al. ..... 418/55.5
5,613,841 A * 3/1997 Bass et al. ..... 418/55.5
5,713,731 A * 2/1998 Utter et al. ..... 418/55.5
5,803,722 A * 9/1998 Noboru et al. ..... 418/55.5

FOREIGN PATENT DOCUMENTS

| | | | | |
|---|---|---|---|---|
| EP | 0 849 471 A1 | | 6/1998 | |
| JP | 58160583 | | 9/1983 | |
| JP | 61-98987 | * | 5/1986 | ..... 418/55.5 |
| JP | 2-218880 | * | 8/1990 | ..... 418/55.5 |
| JP | 5-1677 | * | 1/1993 | ..... 418/55.5 |
| JP | 09-079153 | | 3/1997 | |
| JP | 09088862 | | 3/1997 | |

* cited by examiner

*Primary Examiner*—John J. Vrablik
(74) *Attorney, Agent, or Firm*—Burns, Doane, Swecker & Mathis, LLP

(57) ABSTRACT

Spiral fixed scroll teeth (2*a*) project from an end plate (2*b*) of a fixed scroll (2), and spiral movable scroll teeth (4*a*) project from an end plate (4*b*) of a movable scroll (4). The end plate (4*b*) of the movable scroll (4) is provided with a discharge port (8) for discharging compressed refrigerant gas. A pressure chamber (16) is provided on the back surface of the end plate (2*b*). A port (10) communicating with the pressure chamber (16) is provided on a position of the end plate (2*b*) opposed to the discharge port (8). Thus obtained is a scroll compressor reducing pulsation when discharging a fluid by feeding the compressed fluid into the pressure chamber.

7 Claims, 4 Drawing Sheets

SCROLL TYPE COMPRESSOR HAVING A PRESSURE CHAMBER OPPOSITE A DISCHARGE PORT

TECHNICAL FIELD

The present invention relates to a scroll compressor, and more particularly, it relates to a scroll compressor reducing pulsation caused when discharging a compressed high-pressure fluid.

BACKGROUND ART

As an example of a conventional scroll compressor, an in-shaft discharge type scroll compressor discharging compressed high-pressure refrigerant gas into a casing through a passage provided in a drive shaft driving the compressor is now described.

As shown in FIG. 4, a partition 125 separates a closed casing 101 into a suction chamber 123 and a discharge chamber 122.

The suction chamber 123 is provided therein with a scroll compression mechanism 103 for sucking and compressing refrigerant gas.

The scroll compression mechanism 103 is formed by a fixed scroll 110 and a movable scroll 111. Spiral fixed scroll teeth 110*b* project from an end plate 110*a* of the fixed scroll 110. Spiral movable scroll teeth 111*b* project from an end plate 111*a* of the movable scroll 111. The movable scroll teeth 111*b* fit with the fixed scroll teeth 110*b* thereby forming a compression chamber 114.

A suction port 110*c* is provided on a side surface of the fixed scroll 110 for feeding low-pressure refrigerant gas received from a suction pipe 105 into the compression chamber 114. A discharge port 111*c* is provided on a portion around the center of the end plate 111*a* of the movable scroll 111 for discharging the refrigerant gas compressed to a high-pressure state.

The discharge chamber 122 stores a motor 107. The scroll compression mechanism 103 is driven through a crank part 130 provided on the upper end of a drive shaft 108 of the motor 107. The drive shaft 108 is provided with a discharged gas passage 108*e* for guiding the refrigerant gas discharged from the discharge port 111*c* to a discharged gas outlet 108*f* provided on the lower end of the drive shaft 108.

The suction pipe 105 for feeding the refrigerant gas into the scroll compression mechanism 103 is connected to a portion of the casing 101 closer to the suction chamber 123. A discharge pipe 106 for discharging the high-pressure refrigerant gas from the casing 101 is connected to a portion of the casing 101 closer to the discharge chamber 122.

Operation of the aforementioned scroll compressor is now described.

Rotation of the motor 107 is transmitted to the scroll compression mechanism 103 through the drive shaft 108 and the crank part 130. Thus, the movable scroll 111 revolves with respect to the fixed scroll 110. The compression chamber 114 formed by the movable scroll teeth 111*b* and the fixed scroll teeth 110*b* contractedly moves from the outer peripheral portion toward the central potion due to the revolution of the movable scroll 111.

Thus, the low-pressure refrigerant gas fed from the suction pipe 105 into the compression chamber 114 through the suction port 110*c* is compressed to a high-pressure state and discharged from the discharge port 111*c* of the movable scroll 111.

The high-pressure refrigerant gas discharged from the discharge port 111*c* passes through the discharged gas passage 108*e* provided on the drive shaft 108 and flows out into the discharge chamber 122 from the discharged gas outlet 108*f*. The high-pressure refrigerant gas flowing out into the discharge chamber 122 passes through a clearance between the motor 107 and the casing 101 or the like and is delivered from the casing 101 through the discharge pipe 106.

However, the aforementioned scroll compressor has the following problems:

The compression chamber 114 formed by the movable scroll teeth 111*b* and the fixed scroll teeth 110*b* spirally moves from the outer peripheral portion toward the central portion following revolution of the movable scroll 111. At this time, the refrigerant gas compressed in the compression chamber 114 is discharged from the discharge port 111*c*, whereafter the refrigerant gas compressed in a next compression chamber is discharged.

The scroll compression mechanism 103 intermittently performs such discharge along with revolution of the movable scroll 111, and hence it follows that the discharged refrigerant gas pulsates. The pulsating refrigerant gas may vibrate the drive shaft 108 particularly when passing through the discharged gas passage 108*f*.

Depending on operating conditions of the scroll compressor, further, the natural frequency of the drive shaft 108 may resonate with the vibration frequency of the pulsation to make noise.

DISCLOSURE OF INVENTION

The present invention has been proposed in order to solve the aforementioned problems, and an object thereof is to provide a scroll compressor suppressing vibration or noise by suppressing pulsation of discharged gas.

A scroll compressor according to the present invention comprises a first scroll, a second scroll, a discharge port, a pressure chamber and a port. The first scroll has a first spiral body projecting from an end plate. The second scroll has a second spiral body projecting from an end plate for fitting with the first spiral body and forming a compression chamber. The discharge port is provided on the end plate of one of the first and second scrolls. The pressure chamber is provided on the back surface of the other one of the first and second scrolls. The port is provided on the end plate of the other scroll to communicate with the pressure chamber.

This scroll compressor, suppressing pulsation of a fluid compressed in the compression chamber by introducing the fluid into the pressure chamber, can suppress vibration or noise following such pulsation.

Preferably, the pressure chamber is formed by the other scroll and a lid.

In this case, it is possible to prevent pulsation of the fluid flowing into the pressure chamber from directly influencing a casing of the scroll compressor.

Preferably, the scroll compressor further comprises a relief port provided on the end plate of the other scroll for guiding a fluid in the process of compression to the pressure chamber and a relief valve opening/closing the relief port.

In this case, the relief valve is open when the pressure of the fluid in the compression chamber in the process of compression exceeds the pressure in the pressure chamber for feeding the fluid from the compression chamber in the process of compression into the pressure chamber, so that the pressure of the compression chamber in the process of compression is not increased beyond the pressure in the pressure chamber but over-compression is suppressed while the difference between the pressure of the compression chamber immediately before communicating with the discharge port and a discharge pressure is reduced and pulsation of the discharged fluid can be more suppressed when the compression chamber communicates with the discharge port. The timing for feeding the fluid into the pressure chamber through the relief valve deviates from the timing for discharging the fluid from the discharge port, thereby leveling the pressure of the fluid and reducing pulsation thereof.

More preferably, the discharge port communicates with a passage provided in a drive shaft for driving the first scroll or the second scroll.

In this case, vibration of the drive shaft or the like can be effectively suppressed in the so-called in-shaft discharge type scroll compressor having a drive shaft formed with a passage for passing a fluid therethrough.

Preferably, the first scroll is a fixed scroll, the second scroll is a movable scroll, and the port is provided on the fixed scroll.

In this case, the pressure chamber and the port communicating with the pressure chamber are formed on the side of the fixed scroll, whereby the pressure chamber and the port can be more readily formed as compared with the case of forming the same on the side of the movable scroll.

The foregoing and other objects, features, aspects and advantages of the present invention will become more apparent from the following detailed description of the present invention when taken in conjunction with the accompanying drawings.

BEST MODE FOR CARRYING OUT THE INVENTION

First Embodiment

A scroll compressor according to a first embodiment of the present invention is now described.

Figure 1:
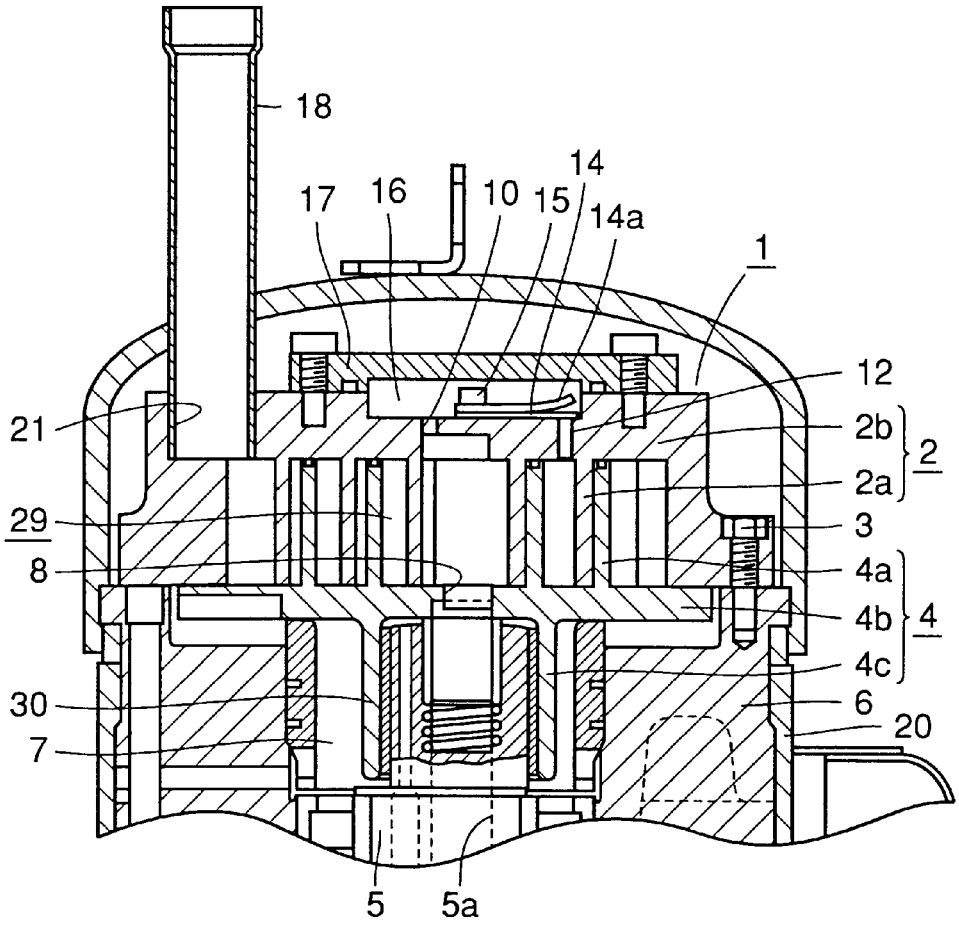
FIG. 1 is a partially fragmented longitudinal sectional view of a scroll compressor according to a first embodiment of the present invention.

As shown in FIG. 1, a scroll compression mechanism 1 for sucking and compressing refrigerant gas is provided in a closed casing 20. The scroll compression mechanism 1 is formed by a fixed scroll 2 and a movable scroll 4. A spiral body (hereinafter referred to as "fixed scroll teeth 2*a*") projects from an end plate 2*b* of the fixed scroll 2.

A spiral body (hereinafter referred to as "movable scroll teeth 4*a*") projects from an end plate 4*b* of the movable scroll 4. The movable scroll teeth 4*a* fit with the fixed scroll teeth 2*a* thereby forming a compression chamber 29.

The scroll compression mechanism 1 is arranged on a framework 6, and particularly the fixed scroll 2 is fixed to the framework 6 with a bolt 3 or the like.

A suction pipe 18 for feeding refrigerant gas into the scroll compression mechanism 1 is connected to an upper portion of the casing 20. A discharge pipe (not shown) foe delivering high-pressure refrigerant gas from the casing 20 is connected to a side surface of the casing 20.

A suction port 21 is provided on the outer peripheral side of the fixed scroll 2 for feeding low-pressure refrigerant gas received from the suction pipe 18 into the compression chamber 29. A discharge port 8 is formed on a portion around the center of the end plate 4*b* of the movable scroll 4 for discharging the refrigerant gas compressed to a high-pressure state.

The casing 20 stores a motor (not shown) in its lower portion. The scroll compression mechanism 1 is driven through a crank part 30 provided on the upper end of a drive shaft 5 of the motor. A crank chamber 7 provided on the framework 6 stores the crank part 30. The drive shaft 5 is provided with a discharged gas passage 5*a* for guiding the refrigerant gas discharged from the discharge port 8 to a discharged gas outlet (not shown) provided on the lower end of the drive shaft 5.

In this scroll compressor, a pressure chamber 16 is provided on the back surface of the scroll not provided with the discharge port 8, i.e., the fixed scroll 2 in particular. The end plate 2*b* of the fixed scroll 2 opposed to the discharge port 8 is provided with a port 10 guiding the discharged refrigerant gas to the pressure chamber 16. The pressure chamber 16 is formed by the fixed scroll 2 and a lid 17.

The scroll compressor is further provided with a relief port 12 for preventing over-compression in compression, a relief valve 14 opening/closing the relief port 12 and a valve guard 14*a* regulating lifting of the relief valve 14.

The relief port 12 connects the compression chamber 29 in the process of compression with the pressure chamber 16. The relief valve 14 and the valve guard 14*a* are arranged in the pressure chamber 16, and fixed to the back surface of the fixed scroll 2 with a bolt 15.

The scroll compressor according to this embodiment has the aforementioned structure.

Operation of the aforementioned scroll compressor is now described.

Rotation of the motor 107 is transmitted to the scroll compression mechanism 1 through the drive shaft 5 and the crank part 30, and the movable scroll 4 revolves with respect to the fixed scroll 2. The compression chamber 29 formed by the movable scroll teeth 4*a* and the fixed scroll teeth 2*a* contractedly moves from the outer peripheral portion toward the central portion due to such revolution of the movable scroll 4.

Thus, the low-pressure refrigerant gas fed from the suction pipe 18 into the compression chamber 29 through the suction port 21 is compressed. The refrigerant gas compressed to a high-pressure state is discharged from the discharge port 8 of the movable scroll 4.

The high-pressure refrigerant gas discharged from the discharge port 8 passes through the discharged gas passage 5*a* provided on the drive shaft 5 and flows out into the casing 20 through the discharged gas outlet (not shown) provided on the lower end of the drive shaft 5. The high-pressure refrigerant gas flowing out into the casing 20 is delivered from the casing 20 through the discharge pipe.

In such serial operation of the scroll compressor, the high-pressure refrigerant gas discharged from the discharge port 8 partially flows into the pressure chamber 16 through the port 10 provided on the position opposed to the discharge port 8.

Thus, as compared with the case where the high-pressure refrigerant gas directly flows from the discharge port 8 into the discharged gas passage 5*a*, the refrigerant gas partially flowing into the pressure chamber 16 is inhibited from pulsation so that vibration of the drive shaft 5 can be suppressed. Further, it is also possible to prevent the natural frequency of the drive shaft 5 from resonating with the vibration frequency of the pulsation and making noise.

Depending on the operating situation, the fluid pressure in the compression chamber 29 in the process of compression may exceed the pressure of the discharge port 8 or the discharge pipe. In other words, the compression chamber 29 may cause over-compression.

When the pressure of the refrigerant gas in the compression chamber 29 in the process of compression exceeds the pressure of the pressure chamber 16, it follows that the relief valve 14 is open so that the refrigerant gas in the process of compression in the compression chamber 29 flows into the pressure chamber 16 through the relief port 12.

Thus, the pressure of the compression chamber 29 in the process of compression is not increased beyond the pressure in the pressure chamber 16 but over-compression is suppressed while the difference between the pressure of the compression chamber 29 immediately before communicating with the discharge port 8 and a discharge pressure is so reduced that pulsation of the discharged refrigerant gas can be more suppressed when the compression chamber 29 communicates with the discharge port 8.

Further, the timing for feeding the refrigerant gas into the pressure chamber 16 through the relief valve 14 deviates from the timing for discharging the same from the discharge port 8, thereby leveling the pressure of the refrigerant gas and reducing pulsation thereof.

In this scroll compressor, the pressure chamber 16 and the port 10 are arranged on the side of the fixed scroll 2, whereby these elements can be more readily formed.

The pressure chamber 16 is formed by the fixed scroll 2 and the lid 17 so that pulsation of the refrigerant gas can be prevented from direct transmission to the casing 20 and the suction pipe 18 can be prevented from overheat due to the provision of the lid 17.

Second Embodiment

A scroll compressor according to a second embodiment of the present invention is now described.

Figure 2:
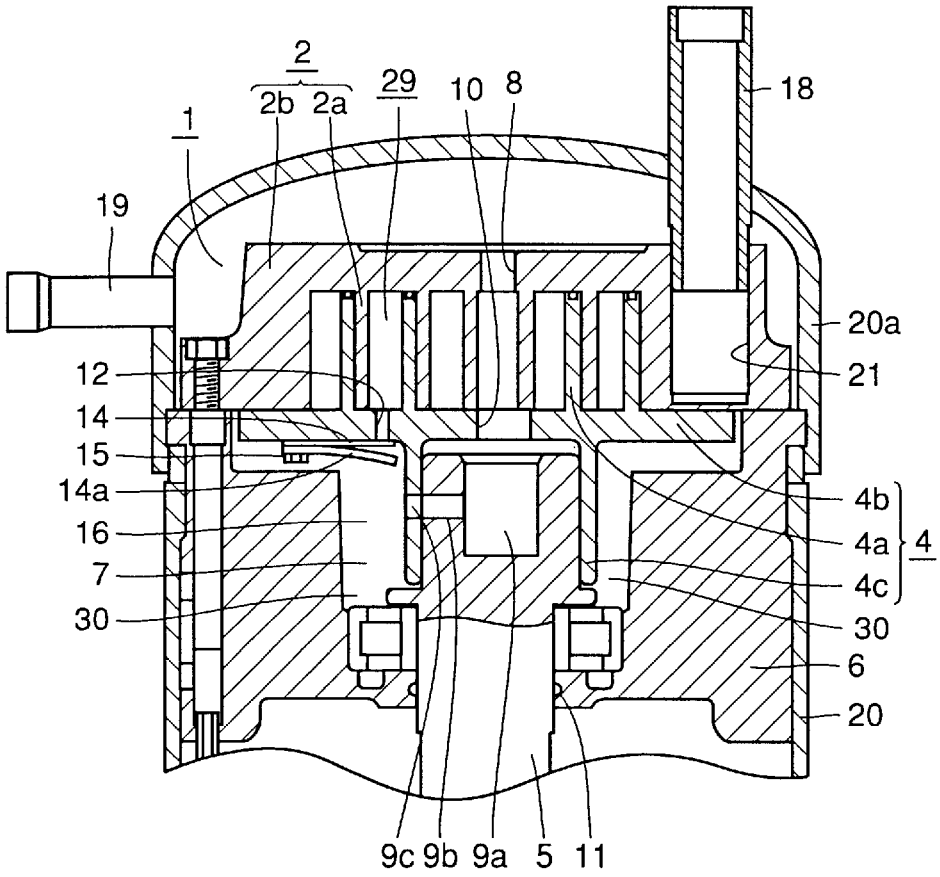
FIG. 2 is a partially fragmented longitudinal sectional view of a scroll compressor according to a second embodiment of the present invention.

As shown in FIG. 2, a pressure chamber 16 is formed on the back surface of a movable scroll 4 in the scroll compressor according to this embodiment. In other words, the pressure chamber 16 is provided in a crank chamber 7 provided on a framework 6 for storing a crank part 30 of the movable scroll 4.

Therefore, a port 10 is formed around the center of the movable scroll 4, while a drive shaft 5 and a boss portion 4*c* are formed with a cavity 9*a* and passages 9*b* and 9*c* for guiding high-pressure refrigerant gas to the pressure chamber 16. A sealing mechanism 11 for sealing the pressure chamber 16 is provided between the framework 6 and the drive shaft 5.

An end plate 4*b* of the movable scroll 4 is provided with a relief port 12 for preventing over-compression in compression, a relief valve 14 opening/closing this relief port 12 and a valve guard 14*a* regulating lifting of the relief valve 14.

The relief port 12 connects a compression chamber 29 in the process of compression with the pressure chamber 16. The relief valve 14 and the valve guard 14*a* are arranged in the pressure chamber 16 and fixed to the back surface of the movable scroll 4 with a bolt 15.

On the other hand, a fixed scroll 2 is provided with a discharge port 8 for discharging compressed high-pressure refrigerant gas. A dome 20*a* is provided with a discharge pipe 19 for delivering the discharged refrigerant gas from a casing 20.

The remaining structure of this scroll compressor is identical to that of the scroll compressor shown in FIG. 1 described with reference to the first embodiment. Therefore, components of the scroll compressor according to the second embodiment identical to those shown in FIG. 1 are denoted by the same reference numerals, and redundant description is not repeated.

Operation of the aforementioned scroll compressor is now described.

Following rotation of the drive shaft 5, the movable scroll 4 revolves with respect to the fixed scroll 2. The compression chamber 29 formed by movable scroll teeth 4*a* and fixed scroll teeth 2*a* contractedly moves from the outer peripheral portion toward the central portion due to the revolution of the movable scroll 4.

Thus, low-pressure refrigerant gas fed from a suction pipe 18 into the compression chamber 29 through a suction pot 21 is compressed to a high-pressure state and discharged from the discharge port 8 of the fixed scroll 2. The high-pressure refrigerant gas discharged from the discharge port 8 is delivered from the casing 20 from the discharge pipe 19 mounted on the dome 20*a* through a space in the dome 20*a*.

In such serial operation of the scroll compressor, the high-pressure refrigerant gas discharged from the discharge port 8 partially passes through the port 10 provided on a position opposed to the discharge port 8 and flows into the pressure chamber 16 through the cavity 9*a* and the passages 9*b* and 9*c*.

Thus, as compared with the case where the high-pressure refrigerant gas directly flows from the discharge port 8 into the space in the dome 20*a*, the refrigerant gas partially flowing into the pressure chamber 16 is inhibited from pulsation and the dome 20*a* as well as the casing 20 can be inhibited from transmission of vibration.

When the pressure of the refrigerant gas in the compression chamber 29 in the process of compression exceeds the pressure of the pressure chamber 16, it follows that the relief valve 14 is open so that the refrigerant gas in the process of compression in the compression chamber 29 flows into the pressure chamber 16 through the relief port 12, similarly to the case of the first embodiment.

Thus, the pressure of the compression chamber 29 in the process of compression is not increased beyond the pressure in the pressure chamber 16 but over-compression is suppressed while the difference between the pressure of the compression chamber 29 immediately before communicating with the discharge port 8 and a discharge pressure is so reduced that pulsation of the discharged refrigerant gas can be more suppressed when the compression chamber 29 communicates with the discharge port 8.

Further, the timing for feeding the refrigerant gas into the pressure chamber 16 through the relief valve 14 deviates from the timing for discharging the same from the discharge port 8, thereby leveling the pressure of the refrigerant and reducing pulsation thereof.

Third Embodiment

A scroll compressor according to a third embodiment of the present invention is now described.

Figure 3:
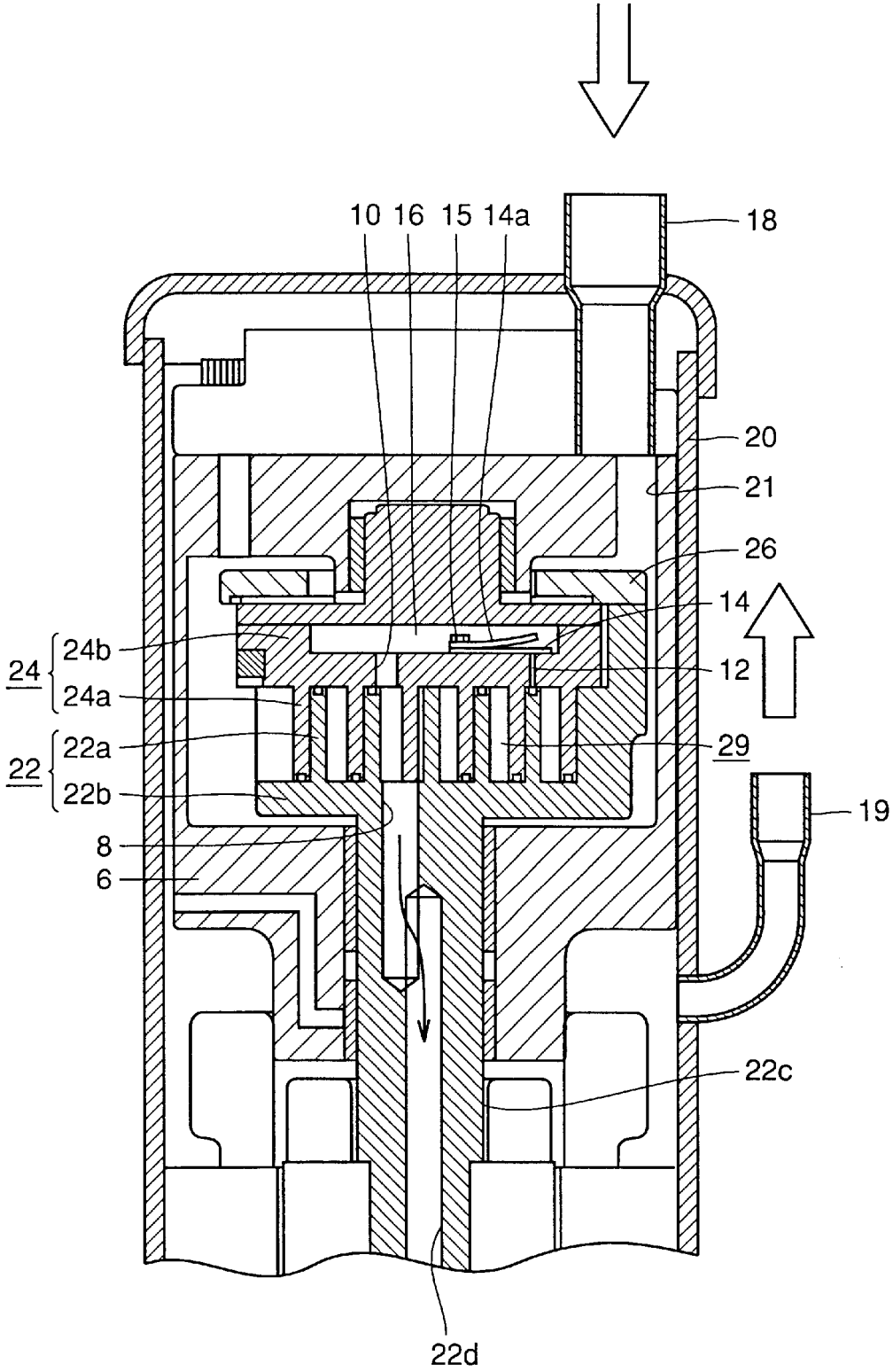
FIG. 3 is a partially fragmented longitudinal sectional view of a scroll compressor according to a third embodiment of the present invention.
Figure 4:
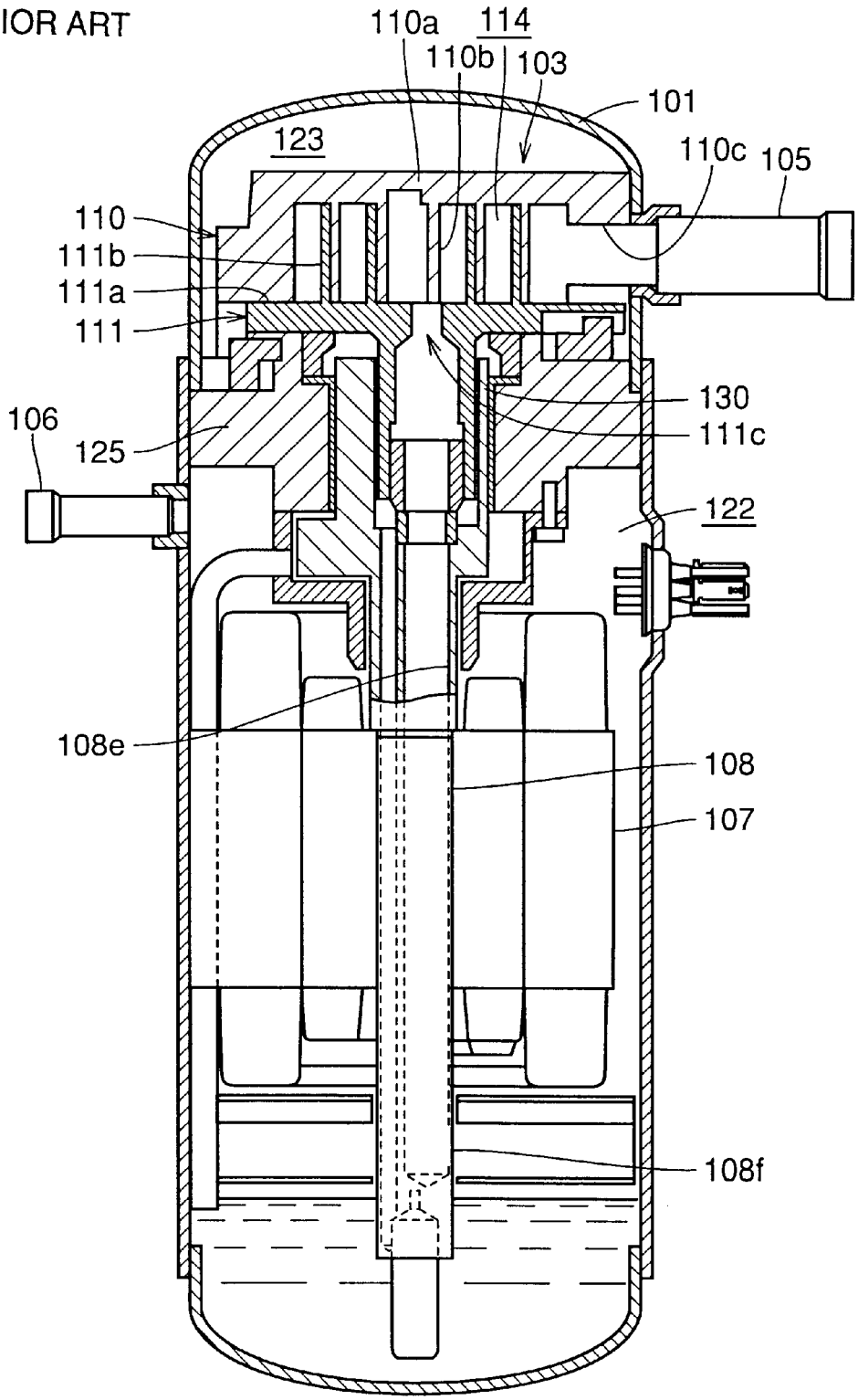
FIG.4 PRIOR ART
FIG. 4 is a partially fragmented longitudinal sectional view of a conventional scroll compressor.

As shown in FIG. 3, the scroll compressor according to this embodiment is the so-called co-rotating scroll compressor having two scrolls 22 and 24 rotating together. In other words, the drive scroll 22 rotates following rotation of a drive shaft 22*c* while the follower scroll 24 revolves with respect to the drive scroll 22 through a coupling 26.

Spiral drive scroll teeth 22*a* project from an end plate 22*b* of the drive scroll 22. Spiral follower scroll teeth 24*a* project from an end plate 24*b* of the follower scroll 24. The follower scroll teeth 24*a* fit with the drive scroll teeth 22*a* thereby forming a compression chamber 29.

The drive scroll 22 is provided with a discharge port 8 for discharging compressed high-pressure refrigerant gas. A pressure chamber 16 is formed in the follower scroll 24 on the side of the back surface of the end plate 24*b*. The end plate 24*b* of the follower scroll 24 opposed to the discharge port 8 is formed with a port 10 guiding the discharged refrigerant gas to the pressure chamber 16.

The end plate 24*b* of the follower scroll 24 is further provided with a relief port 12 for preventing over-compression in compression, a relief valve 14 opening/closing the relief port 12 and a valve guard 14*a* regulating lifting of the relief valve 14.

The relief port 12 connects the compression chamber 29 in the process of compression with the pressure chamber 16. The relief valve 14 and the valve guard 14*a* are arranged in the pressure chamber 16 and fixed to the end plate 24*b* with a bolt 15.

The drive shaft 22*c* is provided with a discharged gas passage 22*d* for guiding the refrigerant gas discharged from the discharge port 8 to a discharged gas outlet (not shown) provided on the side of the lower end of the drive shaft 22*c*. A casing 20 is provided with a discharge pipe 19 for delivering the discharged refrigerant gas from the casing 20.

Operation of the aforementioned scroll compressor is now described.

The drive scroll 22 rotates following rotation of the drive shaft 22*c*. Following rotation of the drive scroll 22, the follower scroll 24 revolves with respect to the drive scroll 22 through the coupling 26. The compression chamber 29 formed by the drive scroll teeth 22*a* and the follower scroll teeth 24*a* contractedly moves from the outer peripheral portion toward the central portion due to the revolution of the follower scroll 24.

Thus, low-pressure refrigerant gas fed from a suction pipe 18 into the compression chamber 29 through a suction pot 21 is compressed to a high-pressure state and discharged from the discharge port 8 of the drive scroll 22. The high-pressure refrigerant gas discharged from the discharge port 8 flows out into the casing 20 through the gas discharge port (not shown) provided on the side of the lower end of the drive shaft 22*c* through the discharged gas passage 22*d* formed in the drive shaft 22*c*. The refrigerant gas flowing out into the casing 20 is delivered from the casing 20 from the discharge pipe 19 mounted on the casing 20.

In such serial operation of the scroll compressor, the refrigerant gas compressed in the compression chamber 29 partially flows into the pressure chamber 16 through the port 10 when discharged.

Thus, as compared with the case where the high-pressure refrigerant gas directly flows from the discharge port 8 into the discharged gas passage 22*d*, the refrigerant gas partially flowing into the pressure chamber 16 is inhibited from pulsation and the drive shaft 22*c* can be inhibited from vibration. Further, the natural frequency of the drive shaft 22*c* can be prevented from resonating with the vibration frequency of pulsation and making noise.

When the pressure of the refrigerant gas in the compression chamber 29 in the process of compression exceeds the pressure of the pressure chamber 16, it follows that the relief valve 14 is open so that the refrigerant gas in the process of compression in the compression chamber 29 flows into the pressure chamber 16 through the relief port 12, similarly to the case of the first embodiment.

Thus, the pressure of the compression chamber 29 in the process of compression is not increased beyond the pressure in the pressure chamber 16 but over-compression is suppressed while the difference between the pressure of the compression chamber 29 immediately before communicating with the discharge port 8 and a discharge pressure is so reduced that pulsation of the discharged refrigerant gas can be more suppressed when the compression chamber 29 communicates with the discharge port 8.

Further, the timing for feeding the refrigerant gas into the pressure chamber 16 through the relief valve 14 deviates from the timing for discharging the same from the discharge port 8, thereby leveling the pressure of the refrigerant gas and reducing pulsation thereof.

The scroll compressor according to the present invention is particularly effective for suppressing vibration of a drive shaft or reducing noise following resonance particularly in an in-shaft discharge type scroll compressor as shown in the first or third embodiment.

The present invention is effectively applied to a structure for suppressing pulsation in a scroll compressor discharging a compressed high-pressure fluid.

Although the present invention has been described and illustrated in detail, it is clearly understood that the same is by way of illustration and example only and is not to be taken by way of limitation, the spirit and scope of the present invention being limited only by the terms of the appended claims.

We claim:

1. A scroll compressor comprising:

a first scroll having a first spiral body projecting from an end plate;

a second scroll having a second spiral body projecting from an end plate for fitting with said first spiral body and forming a compression chamber;

a discharge port provided on said end plate of one of said first and second scrolls, said discharge port communicating with a passage provided in a drive shaft for driving said first scroll or said second scroll;

a pressure chamber provided on the back surface of the other one of said first and second scrolls; and a port provided on said end plate of said other scroll to communicate with said pressure chamber, wherein said port is positioned substantially opposed to said discharge port and wherein said port is substantially straight through said end plate of said other scroll along a direction of extension of the drive shaft.

2. The scroll compressor according to claim 1, wherein said pressure chamber is formed by said other scroll and a lid.

3. The scroll compressor according to claim 1, wherein said first scroll is a fixed scroll, said second scroll is a movable scroll, and said port is provided on said fixed scroll.

4. The scroll compressor according to claim 1, wherein said port is positioned substantially opposed to said discharge port so as to substantially prevent vibration of the drive shaft.

5. The scroll compressor according to claim 1, wherein said port is positioned substantially opposed to said discharge port so as to suppress pulsation of a discharged gas.

6. The scroll compressor according to claim 1, further comprising a relief port provided on said end plate of said other scroll for guiding a fluid in the process of compression to said pressure chamber and a relief valve opening/closing said relief port.

7. The scroll compressor according to claim 6, wherein said relief valve comprises a one-way relief valve for opening and closing said relief port in response to over pressure in said compression chamber.

* * * * *